United States Patent [19]

Hoetker, Jr.

[11] 4,068,609

[45] Jan. 17, 1978

[54] MOORING ANCHOR

[76] Inventor: Carl H. Hoetker, Jr., 615 8th Ave., San Diego, Calif. 92101

[21] Appl. No.: 630,208

[22] Filed: Nov. 10, 1975

[51] Int. Cl.[2] ..... B63B 21/34

[52] U.S. Cl. ..... 114/301; 114/294

[58] Field of Search ..... 9/8 R; 114/206 R, 207, 114/208 R, 209, 230, 65 A, 294, 301

[56] References Cited

U.S. PATENT DOCUMENTS

| | | | |
|---|---|---|---|
| 856,791 | 6/1907 | Mingus | 114/208 R |
| 2,239,889 | 4/1941 | Hobbs | 114/206 R |
| 2,427,604 | 9/1947 | Holter | 114/65 A |
| 3,285,218 | 11/1966 | Gilbertson et al. | 114/207 |
| 3,799,098 | 3/1974 | Taylor et al. | 114/206 R |

*Primary Examiner*—Trygve M. Blix
*Assistant Examiner*—Sherman D. Basinger

[57] ABSTRACT

A mooring anchor made up of a solid, heavy, cylindrical body from which extend rigid upper and lower cross arms that have flukes at the outer ends. The cross arms are spaced at ninety degree intervals around the circumference of the body. The upper cross arm is located appreciably higher on the body than is the lower cross arm. An eye affords a convenient means of attaching a chain or cable. This anchor is intended to provide a good means of anchoring buoys to bottoms that are either of sand or mud. It has no moving parts.

2 Claims, 4 Drawing Figures

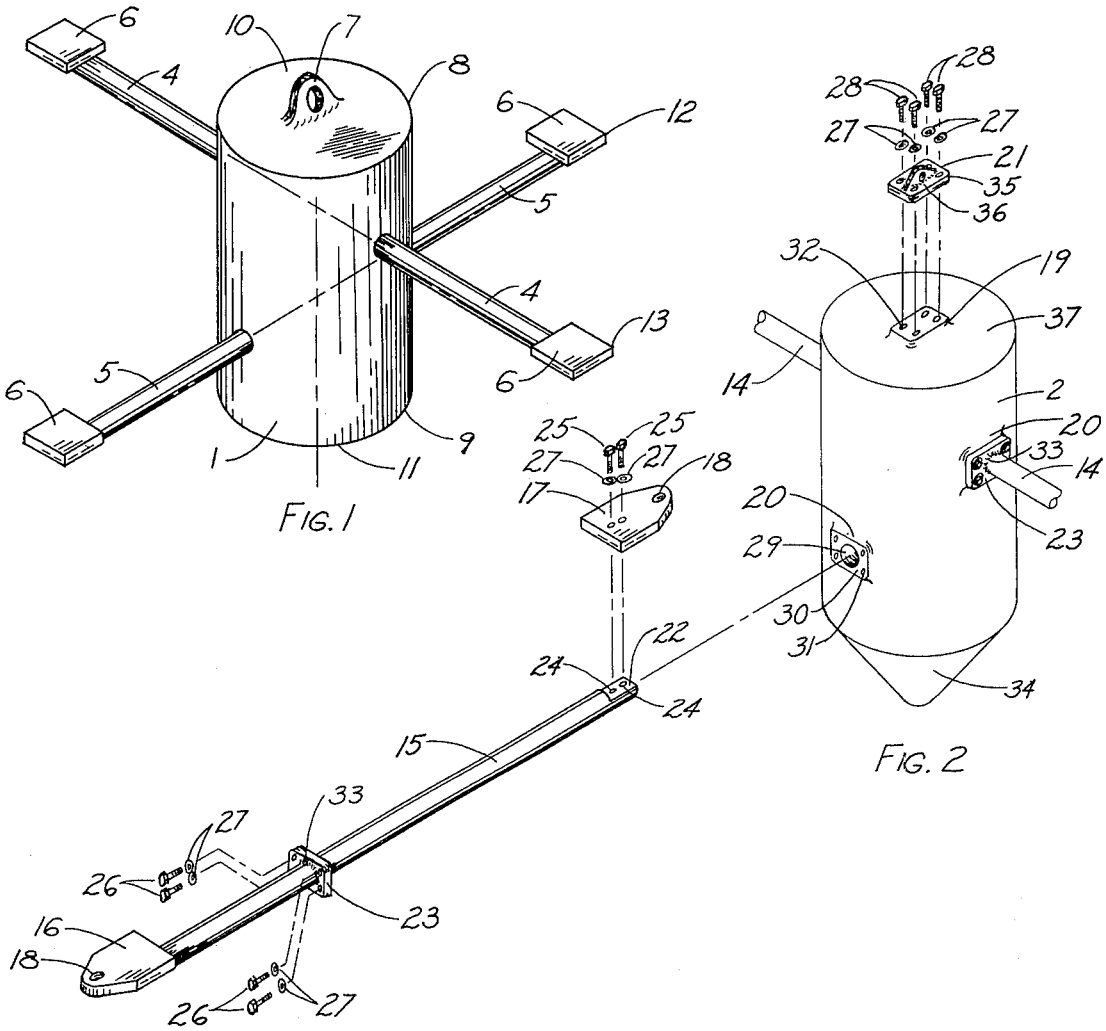
FIG. 1
FIG. 2
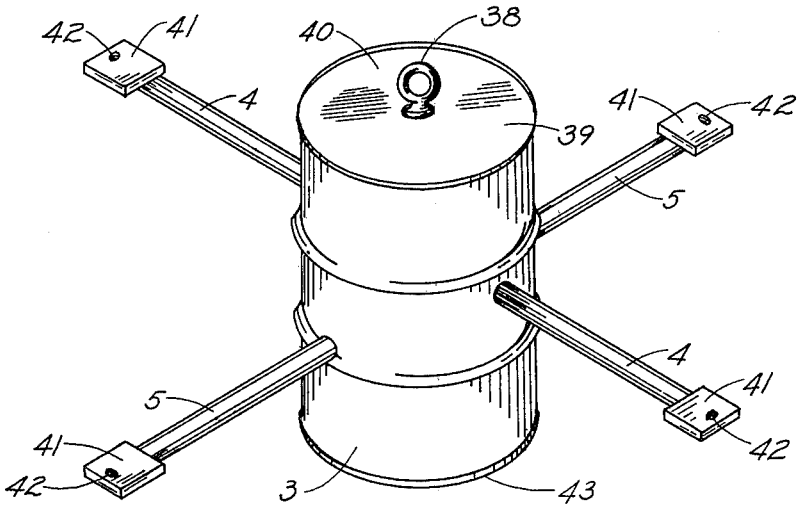
FIG. 3

MOORING ANCHOR

To this anchor is to be attached an anchor chain or other flexible member of sufficient length to allow a buoy connected to its opposite end to float freely on the surface at all times, but whose movement on the surface will be limited to an area bounded by a circle. To this buoy a boat can be tied fast. The object of this invention is to provide a way of anchoring things to the bottoms of waters whose soil characteristics offer a poor hold generally to other kinds of anchors now in use. It is expected that this mooring anchor will exibit superior holding qualities on bottoms of either sand or mud, and will largely overcome dragging and the difficulties caused by balling. Any small inconvenience that may be encountered while handling this anchor, it is thought, would be made up for by the secure hold it will offer the user. The anchor is intended to be left in place on the bottom over long periods of time. Only occasionally would it be necessary to raise it to perform maintenance which would largely consist of preparing properly any rusted areas and repainting to keep it in servicable condition. This invention consists of a solid, heavy, cylindrical body to which are firmly affixed four arms all of which are of the same cross section and are substantial enough to resist deforming by either bending or twisting when in use. Securely affixed to the outer end of each arm is a fluke. These arms are arranged in opposed pairs so as to form an upper cross arm made up of two arms of equal length that have a common axis, and a lower cross arm which is also made up of two arms of equal length that have a common axis. The upper cross arm is located appreciably higher on the body than is the lower cross arm. In operative condition this invention has no moving parts. Therefore some way by whatever method must be used to attatch both the upper cross arm and lower cross arm to the body that will assure that there can be no movement by either cross arm either along its axis or by rotating about it. An eye to afford a convenient means of attaching a chain or cable is securely attached to the top of the body. On the other end is a base that when flat offers a very good way of standing the body in an upright position on any flat, level surface when it is out of the water. These are the parts that together make up a mooring anchor.

Furthermore, the center line of each cross arm will meet and will be perpendicular to the center line of the body in all cases. And the cross arms are arranged so that a plane that contains both the center line of the upper cross arm and the center line of the body will make a right angle with a second plane that contains the center line of the lower cross arm and the center line of the body where they meet in all cases. The offset nature of the cross arms is an important part of this invention and imparts to this anchor certain peculiar properties it would not have if the cross arms were in the same plane. When this anchor is standing upright the top surfaces of the flukes will be level. Symmetry is important in this invention as will become apparent.

FIG. 1 is a perspective view of the anchor.

FIG. 2 is an exploded view that shows one application of the invention. Here the body is a metal casting. A method of securely attatching various parts to the body is shown in detail. The base of this anchor is of conical shape with a rounded tip.

FIG. 3 is a perspective view that shows another application of the invention. In this case the body is a metal drum filled with concrete.

Figure 4:
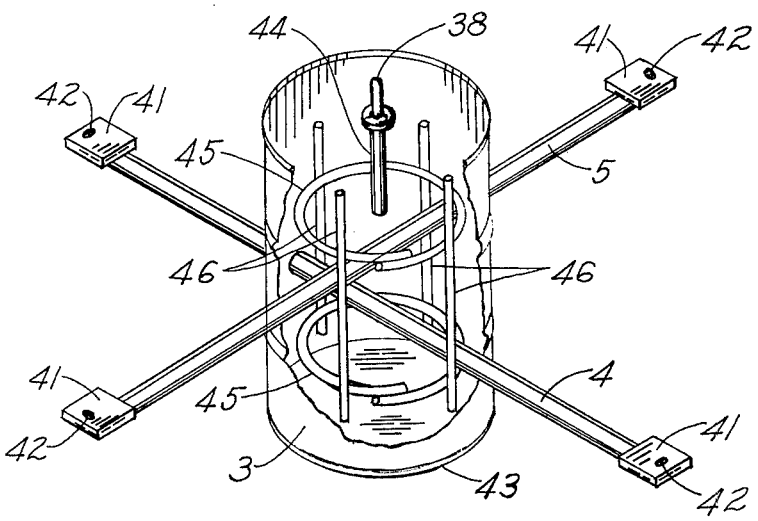
FIG. 4 is a perspective view of the anchor in FIG. 3 before it is filled with concrete. Part of the drum is cut away to show an arrangement of reinforcing rods and the shank portion of the ring.

Referring to FIG. 1. This figure shows a mooring anchor in its basic form. The anchor is made up of a solid, heavy, cylindrical body 1 from which extend an upper cross arm 4 and a lower cross arm 5 that have flukes 6 at their outer ends. The cross arms are spaced at ninety degree intervals around the circumference of the body 1, and the upper cross arm 4 is located appreciably higher on the body 1 than is the lower cross arm 5. An eye 7 to afford a convenient means of attaching a chain or cable is centered on, and securely affixed to the top 10 of the body 1. On the other end is a flat base 11. All the several parts are securely fastened together to make a strong anchor that will have no moving parts. The flat base 11 will afford a very good way of standing the anchor in an upright position. If rested on its side it would be in an awkward and somewhat unstable position. At this time it would be resting on two flukes 6 at the ends of the cross arms, and on either the upper rim 8 or the lower rim 9. It should be noted that in either of these positions it would be in a stable condition while on a level, hard surface, but could be moved from one position to the other with little effort, in much the same way that a seesaw can be moved. It should be noted, too, that the anchor will be resting only on the corners of the flukes. This is pointed out at the corner 13 on the fluke 6 at the end of the upper cross arm 4, and at the corner 12 on the fluke 6 at the end of the lower cross arm 5. Therefore it can be seen that there would be a natural tendency for the flukes to dig in to any surface on which they rest due to the weight of the anchor, but also due to the very small area of the flukes 6 in contact with that surface. It should be realized that no matter how it is placed on is side, it will always come to rest on three points. And these points will always be a fluke 6 at the end of the upper cross arm 4, a fluke 6 at the end of the lower cross arm 5, and either the upper rim 8 or the lower rim 9.

Before the anchor is put in the water, a chain or cable is to be securely attached to the eye 7 by means of standard hardware items usually used for this purpose. The anchor can then be lowered gently to the bottom, or just released over the side to fall through the water by its own weight. On the bottom it will probably come to rest on its side, but it could possibly land upright. If upright, the first strong tug on the anchor chain would topple it onto its side. At this time it would begin to dig in to the generally soft bottom. It would now be resting on two flukes and on one or other of the rims. Suppose now that a strong pull is exerted on the anchor through means of the chain. The anchor would resist movement by forces offered by those areas in contact with the soil. These resisting forces would be the forces offered by the two flukes 6 and, let us say, by the top rim 8. The force offered by the top rim 8 would be in line with the pull from the chain, while the forces offered by the flukes will be off somewhat to each side. Also the flukes will be at different distances from the point where the top rim 8 contacts the bottom. This will cause a side force that will tend to turn the anchor to one side. When this occurs that part of the upper cross arm 4 that is beneath the body 1 will be at an angle that will cause it dig in much more readily than before, while at the same time the lower cross arm 5 will be in a poorer position to dig in. As this happens the anchor will tend to roll in one direction. This will continue until when the anchor is set and holding, the upper cross arm 4 will be nearly vertical. At this time the lower cross arm 5 would tend to stabilize the anchor by resisting any tendency to roll. When the anchor has settled in this position that part of the top 10 in contact with the soil will also resist any movement along the bottom.

The flukes are to have a relatively large surface area, but should be made thin, having just enough thickness to give them adequate strength. This is done to allow the flukes to dig in to the bottom easily. Once in to the soil the relatively large top surfaces will offer great resistance to movement through it. This will be true of all flukes regardless of their surface shape.

While it is most likley that when the anchor is set and holding the upper cross arm 4 will be nearly vertical, the very same result would be had if the reverse were true. In that case the lower cross arm 5 would be nearly vertical, and the upper cross arm 4 would stabilize the anchor.

Also this anchor is symmetrical about any plane passed through the center line of its body 1.

This means that after the anchor has been released and fallen through the water it may land in any position. But if the anchor had gone through another 180 degree in falling it would be in exactly the same position relative to the bottom as before. Only now that part of the upper cross arm 4 that was below the body will be above it, and this will also be true of the lower cross arm 5. In this way a very practical anchor results. After it is released, no matter how it lands on the bottom it is immediately able to dig in.

Therein has been described a mooring anchor that is strong, effective, and durable. And while what has been described has referred to the anchor in FIG. 1, any mooring anchor made according to this description will perform in the same way.

In FIG. 2 the body 2 ia a metal casting that has besses 19 and 20 molded as part of it. These besses 19 and 20 are machined flat to provide smooth surfaces 30 against which flanges are seated during assembly. The boss 19 on the top 37 has four drilled holes 32 that are tapped to accept four cap screws 28 and washers 27 that hold the flange 21 which also has four holes 35 which align with the holes 32 in the boss 19. The flange 21 is made of two pieces that are joined by a weld 36 and is provided with a hole to which can be attached an anchor chain. The upper cross arm 14 and the lower cross arm 15 are made of round bars that have at one end a flattened surface 22 machines smooth that is drilled with two holes 24 and tapped to accept two cap screws 25 and wshers 27 used to firmly secure a fluke 17 that also has two holes that are in alignment with the holes 24 in the cross arms. A flange 23 is slipped over each cross arm and is carefully positioned before the weld 33 is made. Each flange has four holes 35 through it that align with four holes 31 that are drilled and tapped into the bosses 20 to accept four cap screws 26 and washers 27. At the end opposite the flattened surface 22 a fluke 16 is welded to both the upper cross arm 14 and to the lower cross arm 15. Two holes 29 slightly larger than the diameter of the cross arms are bored through the body 2 through which can be placed the cross arms at any time before the flukes 17 are attached to them. The flange is one excellent way of attaching each cross arm to the body 2 so there can be no movement of the arms, but it does more. It adjusts the length of the arms so that finally the fluke 16 and the fluke 17 will be equal distances from the body 2, and it also keys the arms so that the flukes will be positioned correctly in relation to the rest of the anchor. When cast the body 2 is made with a base 34 of conical shape with a rounded tip. This would be done in mooring anchors normally intended for use in fast moving rivers that have mud or sand bottoms. When in use in this way the anchor when set and holding would be situated so that the eye would be down stream. This would result in the base of the anchor being pointed upstream. This base 34 would present much less resistance to the smooth flow of water, than would a base that is flat. While this is one good way of shaping the base for this purpose, any other convex shape to allow a free flow of water around it could also be used. The body 2 of this anchor could be made of cast iron. The holes 18 can be used when handling the anchor to accept shackles used to lift it.

FIG. 3 shows a mooring anchor that has a body made of a steel drum 3 filled with concrete 40. This fulfills the requirement of a solid, heavy, cylindrical body. There are advantages in making an anchor in this way. One is that one of these anchors can be made using inexpensive materials that are readily available almost everywhere. Another advantage is that the drum 3 can serve as a form during construction. To do this the top 39 of the drum 3 is removed and four holes all being equal distances from the drum ends are made in the drum 3 as shown. The cross arms are placed through these holes. The drum 3 is then filled with concrete 40. While the concrete is still wet a ring 38 with a shank portion 44 can be placed in position. After the concrete has hardened flukes 41 can be attached to the cross arm ends. The bottom of the drum 3 serves as a base 43 for this anchor. the concrete 40 in the drum could be strengthened by having additional rods 45 and 46 placed in it.

A good material for the cross arms would be large diameter reinforcing rod of the kind normally used in concrete construction. The upset surface on these rods would serve ideally for this purpose since the rods would be held most securely in the hardened concrete. To the ends of the upper cross arm 4 and the lower cross arm 5 could be welded flukes 41. The holes 42 in the flukes 41 are only for convenience. Through them could be placed shackles used to lift the anchor.

I have that a very good mooring anchor can be made using a small drum of the kind in which automotive lubricant is sold, and using large size concrete reinforcing rods for the cross arms. On this anchor a ring that was purchased at a hardware store is used for an eye. At right angles to the ring's shank were welded two short pieces of reinforcing rod to assure a very strong hold in the concrete.

This anchor is symmetrical about any plane passed through the center line of its body 3. All the requirements for a mooring anchor that have been set forth in this specification are met by the anchor shown in FIG. 3.

I claim:

1. An anchor comprising:

a. a metal drum completely closed at one end having the other end entirely open;

b. two pairs of oppositely disposed holes provided in the walls of said drum; the holes of one pair being spaced longitudinally with respect to the holes of the second pair, and disposed on the drum at right angles to the holes of the second pair; the pairs of holes being located substantially equal distances from the respective ends of said drum;

c. straight rods extending through the pairs of holes, said rods having central portions within said drum and portions of equal length radiating from a central axis perpendicular to the rods;

d. a ring centered outside the open end of said drum, said ring having a shank portion extending within the drum;

e. poured concrete completely filling said drum from end to end; said rods and said ring secured against relative movement by the concrete upon curing; and f. flukes of rectangular shape affixed to the ends of each rod by welds or other means; the surface of each fluke being parallel to the ends of said body.

2. An anchor as set forth in claim 1 where reinforcing rods are placed entirely within the concrete to strengthen the body.

* * * * *